US005303513A

United States Patent [19]

Spiegel

[11] Patent Number: 5,303,513

[45] Date of Patent: Apr. 19, 1994

[54] PORTABLE ABRADING HANDTOOL

[75] Inventor: Kenneth R. Spiegel, Dublin, Ohio

[73] Assignee: Honda of America Mfg., Inc., Marysville, Ohio

[21] Appl. No.: 948,322

[22] Filed: Sep. 22, 1992

[51] Int. Cl.[5] ..... B24B 23/02

[52] U.S. Cl. ..... 51/170 T; 51/170 R; 51/134.5 F

[58] Field of Search ..... 51/134.5 F, 170 R, 170 T, 51/177, 170 MT, 273, 165.9; 433/125

[56] References Cited

U.S. PATENT DOCUMENTS

| | | | |
|---|---|---|---|
| 24,391 | 11/1957 | McFadden | 51/170 |
| 668,552 | 2/1901 | Bailey | 51/170 R |
| 1,152,122 | 8/1915 | Samphere | 15/23 |
| 1,802,078 | 4/1931 | Exley | 15/198 |
| 1,991,764 | 2/1935 | Lovgren | 51/170 R |
| 2,422,733 | 6/1947 | Jimerson | 51/134.5 F |
| 2,732,671 | 1/1956 | McFadden | 51/134.5 F |
| 3,827,834 | 8/1974 | Kakimoto | 51/134.5 F |
| 3,911,625 | 10/1975 | Ise | 51/134.5 F |
| 4,103,460 | 8/1978 | Law | 51/170 R |
| 4,321,722 | 3/1982 | Klocke | 51/170 R |
| 4,531,329 | 7/1985 | Huber | 51/273 |
| 4,622,782 | 11/1986 | Roestenberg | 51/170 T |
| 4,782,632 | 11/1988 | Matechuk | 51/180 |
| 5,031,364 | 7/1991 | Belanger | 51/170 T |

FOREIGN PATENT DOCUMENTS

| | | | |
|---|---|---|---|
| 458112 | 12/1936 | United Kingdom | 51/134.5 F |

*Primary Examiner*—Bruce M. Kisliuk
*Assistant Examiner*—Bo Bounkong
*Attorney, Agent, or Firm*—Vorys, Sater, Seymour & Pease

[57] ABSTRACT

An air powered, portable abrading tool having a valve operable in response to engagement with a surface to be abraded for driving an abrasive disk.

10 Claims, 1 Drawing Sheet

PORTABLE ABRADING HANDTOOL

BACKGROUND OF THE INVENTION

The present invention relates generally to surface abrading devices and, more particularly, to an improved air powered, portable and abrading handtool of the type for removing defects from a painted finish.

The presence of dirt, debris and other contaminants in paint during a painting process, in the production of automobiles, is a significant drawback because they are baked into the finish. These surface defects are typically eliminated by utilizing a piece of fine sandpaper which is used manually to buff the surface defects. While conventional buffing indeed removes these defects, it tends to leave fairly large size scuff marks or "white spots", even if the contaminants are only several millimeters in size. In addition, manual buffing is a relatively time consuming process and there is a tendency for the formation of groove marks if it is not done properly. The presence of relatively large "white spots" and the possibility of groove marks leads to additional refinishing costs and time.

A number of handheld abrading tools are known for treating surfaces of various types. Exemplary ones are described generally in the following U.S. Pat. Nos.: 4,531,329; 4,622,782; 4,782,632; and 5,031,364. However, none of these known devices would satisfactorily serve to remove surface defects caused by surface contaminants baked into a painted finish on an automobile, much less do so in a manner which minimizes user effort and subsequent refinishing steps and costs. Accordingly, there is desire to improve upon presently known abrading techniques and devices for facilitating the efficient abrading of defects so as minimize the size of the white spots and the occurrence of groove marks.

SUMMARY OF THE INVENTION

In accordance with this invention there is provided an improved surface abrading device of the handheld type. In particular, the present invention is related to a portable handheld abrading device which facilitates removal of surface imperfections in a reliable and inexpensive manner. In an illustrated embodiment, provision is made for a portable handheld fluid actuated abrading tool. Included is housing means for being manipulated by a hand of an operator. Fluid actuated driving means includes a rotatable drive shaft within said housing means. The driving means is operable in response to fluid pressure acting thereupon for rotatably driving the drive shaft. An abrading means is provided that is coupled to the drive shaft for abrading a surface to be abraded. Valve means is provided which is relatively slidable in the housing means and operable in response to engagement and disengagement with the surface to be abraded to slide within the housing means between unblocking and blocking conditions to unblock and block respectively, the fluid pressure going to the driving means, whereby when in the unblocking condition, the fluid pressure causes the driving means to rotatably drive the drive shaft.

In another illustrated embodiment, there is included an elongated portable housing of the type which can be held in a hand. Such a housing includes fluid inlet and outlet means associated therewith so that pressurized air can flow therethrough. Rotatable drive means is mounted in the housing and cooperates with the pressurized air for driving a rotary driving member. An abrasive sanding disk is releasably and adhesively secured to a distal end of the driving member for abrading the surface to be treated. The drive means includes an impeller assembly which is mounted in the housing and is rotatable in response to pressurized air. A biased protective sleeve valve is mounted in the housing for sliding translation between inoperative and operative positions. A protective sleeve is on the sleeve valve and surrounds the abrasive disk and protects the surface. An opposite end of the sleeve valve is provided with a valve opening. When the biased sleeve valve is pressed against the work surface, the valve sleeve is moved relatively from a blocking position to an "on" or unblocking position, thereby allowing pressurized air to the handtool for rotating the impeller assembly and thus rotating the driving shaft. When the handtool is lifted from the surface, the biasing of the sleeve valve drives the latter and its opening to the blocking or "off" position, which thereby terminates the flow of the pressurized air to the impeller, thus stopping disk rotation.

In an illustrated embodiment, the protective sleeve is made of a resilient elastomeric material which will not scratch or mar the surface being abraded.

In another illustrated embodiment, the protective sleeve is provided with an access opening which enables attachment of and removal of a sanding disk to and from the rotating driving member.

In another illustrated embodiment, the sleeve valve is provided with biasing means which resiliently urges it and the protective sleeve automatically their inoperative position.

It is an object of the present invention to make provisions for an improved handheld abrading tool; the provision of an improved handtool of the last noted type in which the operation thereof is responsive to in operator engaging the surface to be treated; the provision of an improved handtool of the last noted type which include a resilient protective shield for protecting a sanding disk when the shield is in one position and which is movable in response to engagement with the surface to be treated to allow the sanding disk to be exposed for sanding the surface and for opening a valve to allow fluid pressure to drive the disk; the provision of an improved valve sleeve which is provided with an equatorial opening for allowing access and removal of the sanding disk from the drive member; the provision of a handtool, as noted, which is easy and reliable to use, and the provision of a handtool whose operation is in response to engagement of the surface to be treated.

The above and other objects and further scope of applicability of the present invention will become apparent upon reading the detailed description of the invention when taken in conjunction with the accompanying drawings in which like reference numerals indicate like structure throughout the several views.

DETAILED DESCRIPTION

Figure 1:
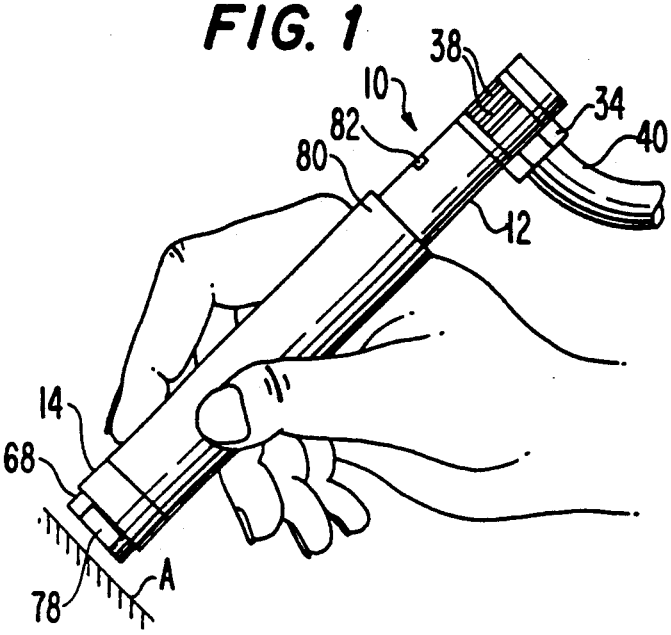
FIG. 1 is perspective view of a portable handheld abrading device of the present invention.

Reference is made to FIGS. 1-5 for illustrating one preferred embodiment of an improved portable, abrading handtool 10 which is particularly adapted for use in removing surface defects from a painted finish, for example, on a recently painted automobile in an efficient and expeditious manner. The handtool 10 is to be held in the hand of an operator, much as a pencil, and is applied to the surface of an automobile body A for purposes of removing surface defects, through abrasion, in the paint, such as baked contaminants of small size (e.g. several millimeters).

Towards this end, the handtool 10 comprises a generally cylindrical housing 12 made of any suitable material and having at a distal working end thereof an enlarged diametered sleeve portion 14. The housing 12 serves to rotatably mount an elongated driving shaft 16 having removably attached at one end thereof a sanding or abrading disk 18. In this embodiment, the driving shaft 16 is driven by suitable pressurized air powered driving means generally depicted at 20 which is located at the proximal end of the handtool; opposite the disk 18. The pressurized air can be delivered in a range of about 0 to 140 psi. Selective control of the application of air pressured air 12 to the handtool is effected by means an "on/off" slidable casing valve sleeve 22. The cylindrical housing 12 serves to slidably mount the casing valve 22. As will be described in greater detail, movement of the valve sleeve 22 unblocks and blocks the driving means 20 to pressurized air. The valve sleeve 22 moves to the open position when the handtool is brought to bear against the surface A. The valve sleeve 22 moves to the closed position when the handtool 10 is removed from the surface A.

Figure 2:
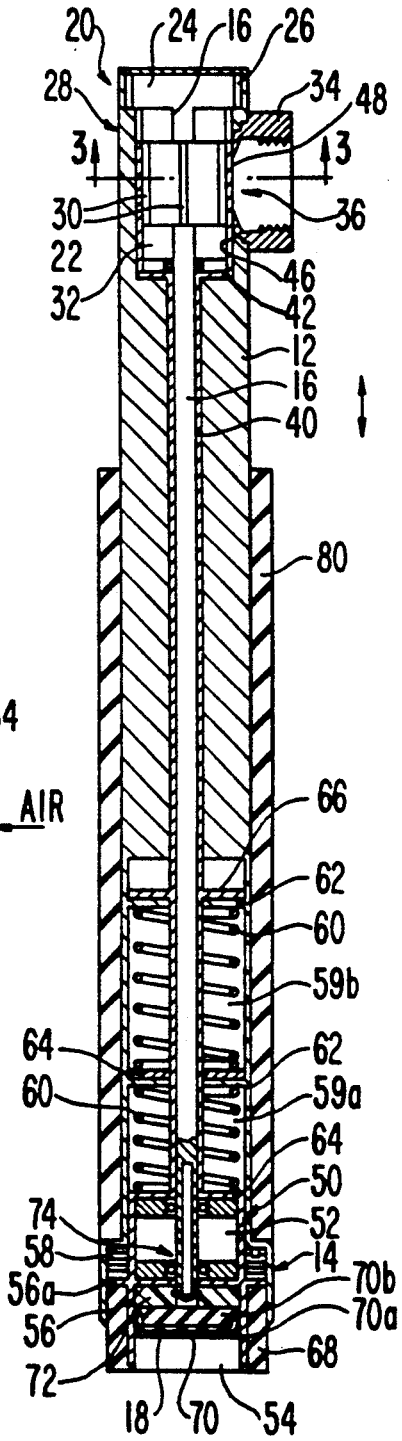
FIG. 2 is a longitudinal cross-sectional view of the handtool depicted in FIG. 1.
Figure 3:
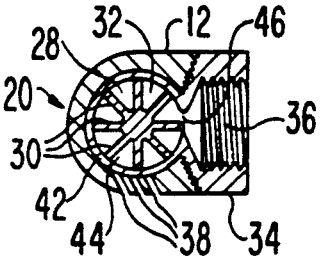
FIG. 3 is a cross-sectional view taken along sectional line 3—3 and looking in the direction of the arrows.
Figure 4:
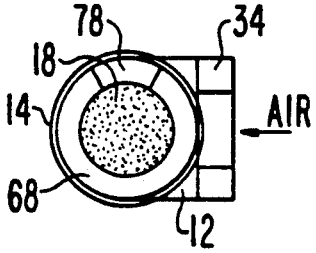
FIG. 4 is a bottom end view of the portable handheld abrading tool of FIG. 1; and, FIG. 5 is an enlarged fragmentary view illustrating more details of the structure of the present invention.

Reference is made back to the driving shaft 16 which is seen in FIGS. 2 and 3 to include an enlarged diametered bearing engaging portion 24 that is rotatably supported by a bearing assembly generally indicated by reference numeral 26 located in the upper portion of the housing 12. Connected to the upper portion of the driving shaft 16 is an impeller assembly 28 which comprises a plurality of circumferentially spaced and longitudinally extending vanes 30. The vanes 30 are adapted to rotate in an impeller chamber 32 the latter of which is formed in a recess of the housing 12. Rotation occurs in response to the positive air pressure introduced into the chamber 32.

The housing 12 has connected thereto adjacent a proximal end thereof, a threaded fluid fitting 34 that fluidly communicates with an air inlet 36 through which the pressurized air can flow into the impeller chamber 32 and out thereof through a series of circumferentially spaced and longitudinally extending air outlet slots 38 (FIG. 3) which are in fluid communication with the chamber 32. Any suitable source of pressurized air can actuate the driving means 20 and is delivered thereto through inlet hose 40.

Reference is now made back to the casing valve sleeve 22 which is slidably positionable within the housing 12 in response to pressure contact, in a manner to be described, so as to open and close the air inlet 36. The slidable valve casing 22 section includes a thin tubular metallic intermediate portion 40 which slides on the rotatable shaft 16. At the upper proximal end of the casing sleeve valve 22 is a receptacle 42 for movement within the impeller chamber 32. The enlarged receptacle 42 slidably fits between a wall of the chamber 32 and the radial extent of the vanes 30. A shaft bearing assembly is mounted in the receptacle 42 for axial movement. In addition, the receptacle 42 has exit openings 44, which as shown in FIG. 3 are in register with the air outlet slots 38. Moreover, the receptacle 42 has a valve inlet opening 46 (FIGS. 2 & 3) which is, when the valve sleeve 22 is in the open position in register with the inlet 36 to allow the pressurized air to drive the vanes 30. When the valve sleeve 22 is in the closed position (FIG. 2) a wall portion 48 thereof blocks the inlet 36 stop the flow of air to the handtool 10. It will be appreciated that when the valve sleeve 22 is vertically moved upwardly relative to the housing 12, the valve inlet opening 46 moves into register with the air inlet 36 to thereby allow the pressurized air to drive the impeller vanes 32 and thus rotate the driving shaft 16.

Figure 5:
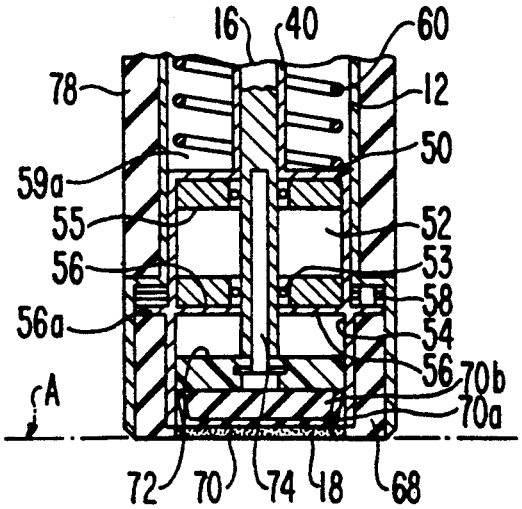

As best seen in FIGS. 2 and 5 the opposite end of the slidable valve casing 22 is defined by an enlarged sanding assembly 50 as shown in FIGS. 2 and 5 which includes recesses 52 and 54. A pair of conventional bearings 55 (FIG. 5) are mounted in the recess 52 and movable with the sleeve 22. In addition, there is a crosspiece 56 with an annular flange portion 56*a* for supporting a coil spring 58 within the enlarged working end portion 14 which spring acts to drive to sanding assembly 50 outwardly and downwardly.

Referring back to the housing 12, it defines a plurality of recess 59*a, b*. A spring member 60 is mounted within each recesses 59*a, b*. One end of each spring 60 is abutting a housing flange 62 and the other end of each spring is engaging a flange 64 of the sleeve 22. A retaining flange 66 on the sleeve moves in a housing retaining space for positively limiting movement of the sleeve 22 relative to the housing 12 when the flange 66 engages the housing. The springs 58, 60 serve to bias valve sleeve 22 downwardly and outwardly relative to the working end portion 14 of the housing.

A sponge rubber protective sleeve 68 is mounted on the distal end of the enlarged sanding assembly 50. The sponge rubber protecting sleeve 68 is arranged to have its distal end engage and protect the surface to be abraded as well as surround the abrading disk 18. The sleeve does not scratch or mar the surfaces. The sanding assembly 50 also includes scratch protector assembly 70 made of an external soft rubber component 70*a* upon which the sanding disk 18 is releasably and adhesively mounted. The sanding disks 18 can be, for example, obtained from the 3M Company. The scratch protector assembly 70 includes a hard rubber component 70*b* which is, in turn, connected to a fiberglass disk 72 that is secured to the driving shaft 16 by a washer and center bolt arrangement 74. In the operative position of the handtool 10 as shown in FIG. 5, the rotating sanding disk 18 abrades the surface A.

The scratch protector sleeve 68 has a side access opening 78 which provides access to an operator for conveniently attaching and removing the sanding paper disk 18 to and from the scratch protector assembly 70. As noted, the sanding paper disk 18 has a releasable self-adhesive backing sheet for releasable attachment to the scratch protector assembly 70.

In the illustrated embodiment, a sponge rubber manual grip 80 is fitted onto the periphery of the housing 12 so as to minimize vibration and facilitate comfortable manual usage. Furthermore, an electronic switch (not shown) can be provided for, of the type which will be actuated by upward movement of the slidable sleeve 22 to open and close a valve associate with the source of pressurized fluid to the handtool 10. Also, a set screw 82 is provided for holding each half section of the tool together for easy maintenance and oiling of the center pin without taking the tool completely apart.

After having explained in detail the construction of the handtool 10, its operation is believed self-evident. A brief description of its operation, however, follows to supplement such description. In this connection, when an operator decides to sand the surface A, the sponge rubber protecting sleeve 68 is pressed against surface to be sanded. This pressing engagement causes the slidable casing sleeve 22 to move upwardly relative to the downwardly moving housing 12, against the bias of springs 58 and 60. As a result, the valve opening 46 which had been out of registry (FIG. 2) with the air inlet 36 is moved to a position (FIG. 3), whereby it is in registry. Accordingly, the pressurized air from the source is allowed to drive the impeller vanes 30 in a manner so as to rotatably drive shaft 16 and hence rotate the disk 18. For example, it is contemplated that the disk 18 can be rotated at about 8,000 rpm. Of course, the pressurized air exits the housing through exit slots 38 and 44. Moreover, the construction of the present invention is extremely lightweight and durable.

When the operator decides to stop the sanding operation, the handtool 10 is merely lifted from the surface A, thereby allowing the resilient action provided by the springs 58 and 60 to return the valve sleeve 22 and protective sleeve 68 to its outward position relative to the housing 12, as shown in FIGS. 1 and 2. Whenever in this position, the valve sleeve 22 is positioned so that its valve opening 46 is out of register with the air inlet 36, thereby closing off the impeller assembly 28 from the source of pressurized air. As a consequence, rotation of the driving shaft 16 is stopped and so is the sanding.

Since certain changes may be made in the above handtool without departing from the scope of the invention involved, it is intended that all matter contained in the description thereof or shown in the accompanying drawings shall be interpreted as illustrative and not in a limiting sense.

What is claimed is:

1. A portable handheld fluid actuated abrading tool comprising:

housing means for being manipulated by a hand of an operator;

fluid actuated driving means including a rotatable drive shaft within said housing means, said driving means being operable in response to fluid pressure acting thereupon for rotatably driving said drive shaft;

abrading means coupled to said drive shaft for abrading a surface to be abraded;

valve means relatively movable in said housing means and operable in response to engagement and disengagement of said abrading means with the surface to be abraded to move within said housing means between unblocking and blocking conditions to unblock and block respectively, the fluid pressure going to said driving means, whereby when in said unblocking condition the fluid pressure causes said driving means to rotatably drive said drive shaft and when said abrading means is disengaged from the surface to be abraded said valve means is in said blocking condition whereby rotation of said drive shaft ceases.

2. The portable abrading tool of claim 1, in which said fluid actuated driving means is within said housing means and includes an impeller assembly coupled to said drive shaft, said housing means having housing inlet means and outlet vents, wherein unblocked pressurized fluid admitted through said housing inlet means rotates said impeller assembly to thereby rotate said drive shaft, and said vents allow the pressurized fluid to exit from said housing means.

3. The portable abrading tool of claim 2 wherein said valve means is slidable within said housing means and includes biasing means, and a cylindrical valve portion having a valve opening and being slidable in said housing means, said valve opening is normally biased by said biasing means to a blocking condition of said slidable valve means relative to said housing inlet means, and said slidable valve means is disposable to be in register with said housing inlet means to allow pressurized fluid to flow to said impeller assembly when said slidable valve means is pressingly engaged with the surface to be abraded.

4. The portable abrading tool of claim 3 wherein said biased slidable valve means includes a protective sleeve adjacent an end thereof which sleeve is adapted to engage the surface to be abraded, said protective sleeve surrounding said abrading assembly when said slidable valve means is in said blocking condition and moves to allow said abrading assembly to abrade the surface when in said unblocking condition.

5. The portable abrading tool of claim 4 wherein said protective sleeve is made of an elastomeric material which resists scratching and marring surfaces to be abraded.

6. The portable abrading tool of claim 5 wherein said abrading means includes an abrading disk having a releasably adhesive surface for being releasably attachable to said drive shaft.

7. The portable abrading tool of claim 6 wherein said sleeve has at least a side access opening which allows said abrading means to be accessed by an operator for easy attachment and removal thereof.

8. The portable abrading tool of claim 5 wherein said cylindrical portion is slidably interposed between said impeller assembly and said housing inlet means for translational movement in said housing means.

9. The portable abrading tool of claim 4 wherein said slidable valve means includes an intermediate portion which slidably translates within said housing means relative to said driving shaft and is coupled to said cylindrical portion.

10. The portable abrading tool of claim 2 wherein said fluid drive means is constructed to be actuated by air pressure.

* * * * *